US007293591B2

(12) United States Patent
Nakagawa et al.

(10) Patent No.: US 7,293,591 B2
(45) Date of Patent: Nov. 13, 2007

(54) SYSTEM FOR MOUNTING PRODUCTS TO A TAPE

(75) Inventors: Yukio Nakagawa, Ritto (JP); Masashi Kondo, Ritto (JP); Yoshio Iwasaki, Ritto (JP)

(73) Assignee: Ishida Co., Ltd., Kyoto (JP)

( * ) Notice: Subject to any disclaimer, the term of this patent is extended or adjusted under 35 U.S.C. 154(b) by 146 days.

(21) Appl. No.: 10/779,662

(22) Filed: Feb. 18, 2004

(65) Prior Publication Data

US 2004/0168774 A1 Sep. 2, 2004

(30) Foreign Application Priority Data

Feb. 28, 2003 (JP) ..... 2003-052727
Jan. 14, 2004 (JP) ..... 2004-006619

(51) Int. Cl.
*B32B 37/00* (2006.01)

(52) U.S. Cl. ..... 156/362; 156/552; 156/556; 156/566; 53/136.1

(58) Field of Classification Search ..... 156/265, 156/253, 302, 513, 522, 552, 556, 566, 567, 156/568, 539, 350, 361, 362; 53/136.1, 555, 53/591; 493/380, 478
See application file for complete search history.

(56) References Cited

U.S. PATENT DOCUMENTS 3,038,596 A 6/1962 Anstett
3,864,895 A 2/1975 Petrea et al.
5,433,060 A 7/1995 Gur et al.
6,726,794 B2 * 4/2004 Belt ..... 156/265
2003/0000179 A1 * 1/2003 Nakagawa et al. ..... 53/493

FOREIGN PATENT DOCUMENTS

EP 1350722 A1 * 10/2003
FR 1469190 A 4/1967
GB 2060542 A * 5/1981
JP 54070192 A * 6/1979

* cited by examiner

*Primary Examiner*—James Sells
(74) *Attorney, Agent, or Firm*—Global IP Counselors, LLP

(57) ABSTRACT

A tape mounting system 1 mounts a product X to a strip tape T, and includes a tape holding mechanism, a mounting mechanism and a control unit 70. The tape holding mechanism has a payout roller 61 and a carry-out conveyor 64, and holds the strip tape T in a horizontal state. The mounting mechanism has a clamp 62 and a heater block 63, and mounts the product X to the strip tape T by attaching a portion X2 to the strip tape T. The control unit 70 controls the tape holding mechanism and mounting mechanism such that the portion X2 of the products X vertically overlaps the strip tape T. The tape mounting system that reduces positional deviation of the portion X2 and the strip tape T during the mounting of product X to the tape T caused by positional deviation of the tape T.

25 Claims, 12 Drawing Sheets

SYSTEM FOR MOUNTING PRODUCTS TO A TAPE

BACKGROUND OF THE INVENTION

1. Field of the Invention

The present invention generally relates to a tape mounting system that mounts products to a tape.

2. Background Information

A bag manufacturing and packaging machine is an example of an apparatus that manufactures bags and packages articles by manufacturing a bag while filling the inside of the bag with articles to be packaged, such as snacks and candies. For example, in a bag manufacturing and packaging machine called a longitudinal pillow-type packaging machine, a former forms packaging material, which is a sheet-shaped film, into a tubular shape, and a longitudinal sealing mechanism heat seals (thermally welds) the overlapping longitudinal edges of the tubularly shaped packaging material, thus forming a tubular packaging material. Further, once the tubular packaging material, which will ultimately form a bag, is filled with articles to be packaged, a transverse sealing mechanism below the tube heat seals the upper end part of the bag, which is also the lower end part of the successive bag, and a cutter subsequently horizontally cuts the center of that heat sealed part (the transverse seal part).

U.S. Pat. No. 3,864,895 discloses an apparatus in which a tape mounting mechanism is provided on the side of such a bag manufacturing and packaging machine, products (bags) manufactured by the bag manufacturing and packaging machine are transported to this tape mounting mechanism, and are successively mounted to a strip tape that descends vertically.

The apparatus in the abovementioned U.S. Pat. No. 3,864,895 mounts products to a strip tape by suspending the strip tape from a roller, spraying a hot melt (adhesive) onto the strip tape in a substantially vertical state, and pressing the strip tape against the upper end part of the product.

However, in the case of mounting products to a strip tape in a vertical state, there is a relatively strong potential for the strip tape to undesirably move in a direction orthogonal to the longitudinal direction (vertical direction) of the strip tape. As a result, there is a risk of failures in product mounting, deviations in the product mounting position, and the like.

In addition, the products must be pressed against the strip tape for at least a prescribed period of time when mounting the products to the strip tape using an adhesive of the abovementioned type. Furthermore, the products must also be pressed against the strip tape for at least a prescribed period of time when mounting the products to the strip tape by thermal welding. Accordingly, in the apparatus of U.S. Pat. No. 3,864,895, wherein products are mounted to the strip tape in a vertical state, there is a risk that the weight of each product itself will act upon the adhering part of the strip tape, causing the product to fall off the strip tape before the product sufficiently adheres to the strip tape.

In view of the above, it will be apparent to those skilled in the art from this disclosure that there exists a need for an improved tape mounting mechanism that overcomes the above-described problem. This invention addresses this need in the art as well as other needs, which will become apparent to those skilled in the art from this disclosure.

SUMMARY OF THE INVENTION

It is an object of the present invention to provide a tape mounting system that reduces the deviation in the positions at which products are mounted to a tape caused by deviations in the position of the tape. It is another object of the present invention to provide a tape mounting system in which there are few incidences of products falling off the strip tape.

The tape mounting system according to the present invention is a system that mounts a product to a tape, and includes a tape holding mechanism, a mounting mechanism, and control means. The tape holding mechanism holds the tape substantially horizontally. The mounting mechanism mounts the product to the tape by attaching a portion of the product to the tape. The control means is operatively coupled to the tape holding mechanism and the mounting mechanism for controlling the tape holding mechanism and the mounting mechanism such that the portion of the product vertically overlaps the tape while the portion of the product is attached to the tape.

Herein, the tape is held in a substantially horizontal state, and the product is mounted to the tape by attaching a portion of the product to the tape, such that the portion of the product vertically overlaps that tape. Accordingly, the risk of an undesirable deviation from the desired positions of the product and the tape is reduced during mounting. In other words, in cases where products are mounted to a tape while the tape is in a vertical state, there is an increased risk that the tape will deviate in a direction orthogonal to the longitudinal direction. Herein, since the product is mounted to a tape, while the tape is held in a substantially horizontal state with the portion of the product to be attached to the tape vertically overlapping the tape, deviation of the portion of the product relative to the tape, which is caused by deviation of the tape, is less likely to occur.

In particular, if the tape is made of a material that is more flexible than a material of which the product is made, then the stability of the tape position before or during the attachment of the portion of the product increases more if the tape is held in a horizontal state than if held in a vertical state.

In addition, the mounting mechanism has a heater and, in cases where the portion of the product is attached to the tape by heating, it is not preferable if force that separates both the tape and a product is applied to the thermal welding part until the thermal welding part is sufficiently cooled. However, in cases where products are mounted to the tape by heating, the problem wherein a product falls off the tape after the thermal welding due to the weight of the product itself is reduced if the products are attached to the tape while the tape is held in a horizontal state. Accordingly, the present invention is particularly effective when a thermal welding system is utilized and when the products are heavy.

In addition, the tape can be rendered adhesive at least at a part where the portion of the product is attached, such that the product is pushed against and attached to the tape having adhesive characteristics in at least in a part where the portion of the product is to be attached. The adhesiveness can be obtained by utilizing a tape that is partially adhesive, or by applying an adhesive substance to the tape. In this case, the risk of a product falling off the tape after welding due to the weight of the product itself is also reduced if the product is attached to the tape while the tape is held in a horizontal state. Accordingly, even if the product is heavy, it is possible to use a tape with a relatively low strength adhesive, or a substance with a relatively low strength adhesive that is applied to the tape.

The tape mounting system according to the present invention may also be a system further including a product placing mechanism that places the product onto the mounting mechanism. The control means controls the product placing mechanism such that the portion of the product vertically overlaps the tape while the portion of the product is attached to the tape. With such product placing mechanism, then it becomes possible to reliably overlap the tape and the products in the vertical direction.

The tape mounting system according to the present invention may also be a system further including a product transfer mechanism. The product transfer mechanism transfers the product toward the mounting mechanism.

Here, the product transport mechanism transports products discharged from a packaging machine that, for example, packages articles to produce packaged products. Herein, the product transfer mechanism transfers products transported by the product transport mechanism to a location where there is a tape held by the tape holding mechanism. This tape mounting system can arrange the tape holding mechanism at a location spaced apart from the product transport mechanism. In so doing, it no longer becomes necessary to consider interference with the product transport mechanism, and the structure of the tape holding mechanism can consequently be simplified. For example, the tape mounting system may be structured such that the product transport mechanism and the tape holding mechanism are spaced apart in the width direction. Also, the tape mounting system may be structured such that the product transport mechanism and the tape holding mechanism are spaced apart in the vertical direction. Furthermore, the tape mounting system may be structured such that the product carry-out mechanism and the tape holding mechanism are spaced apart in the width direction.

In addition, in the case of a tape mounting system having a product placing mechanism, the product placing mechanism may have a grasping member that grasps the product, or a suction member that holds products by suction.

In addition, in the case of a tape mounting system having a product placing mechanism, the tape mounting system further include a product transfer mechanism that transfers the product placing mechanism toward he mounting mechanism.

Furthermore, the product transfer mechanism may have a product orientation change mechanism that changes the orientation of the product. If there is such a product orientation change mechanism, then it becomes possible to keep a constant mounting orientation of the products with respect to the tape.

In addition, in the case of a tape mounting system having a product placing mechanism, the product placing mechanism may also serve as a pressing mechanism that applies pressure to the products to check the seals of the products.

In addition, in the case of a tape mounting system provided with the product placing mechanism and the product transfer mechanism, the tape mounting system may further include imaging means. The imaging means produces an image signal of the product before the product is mounted onto the tape. The control means controls the product transfer mechanism based on the image signal from the imaging means. Herein, the tape and the products can be made to more reliably overlap in the vertical direction.

The tape mounting system according to the present invention mounts products to a tape such that a portion of the products vertically overlaps the tape, and the tape is held in a substantially horizontal state. This consequently reduces the risk that the products and the tape will undesirably deviate from the desired state of their relative positions when performing mounting.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

Figure 1:
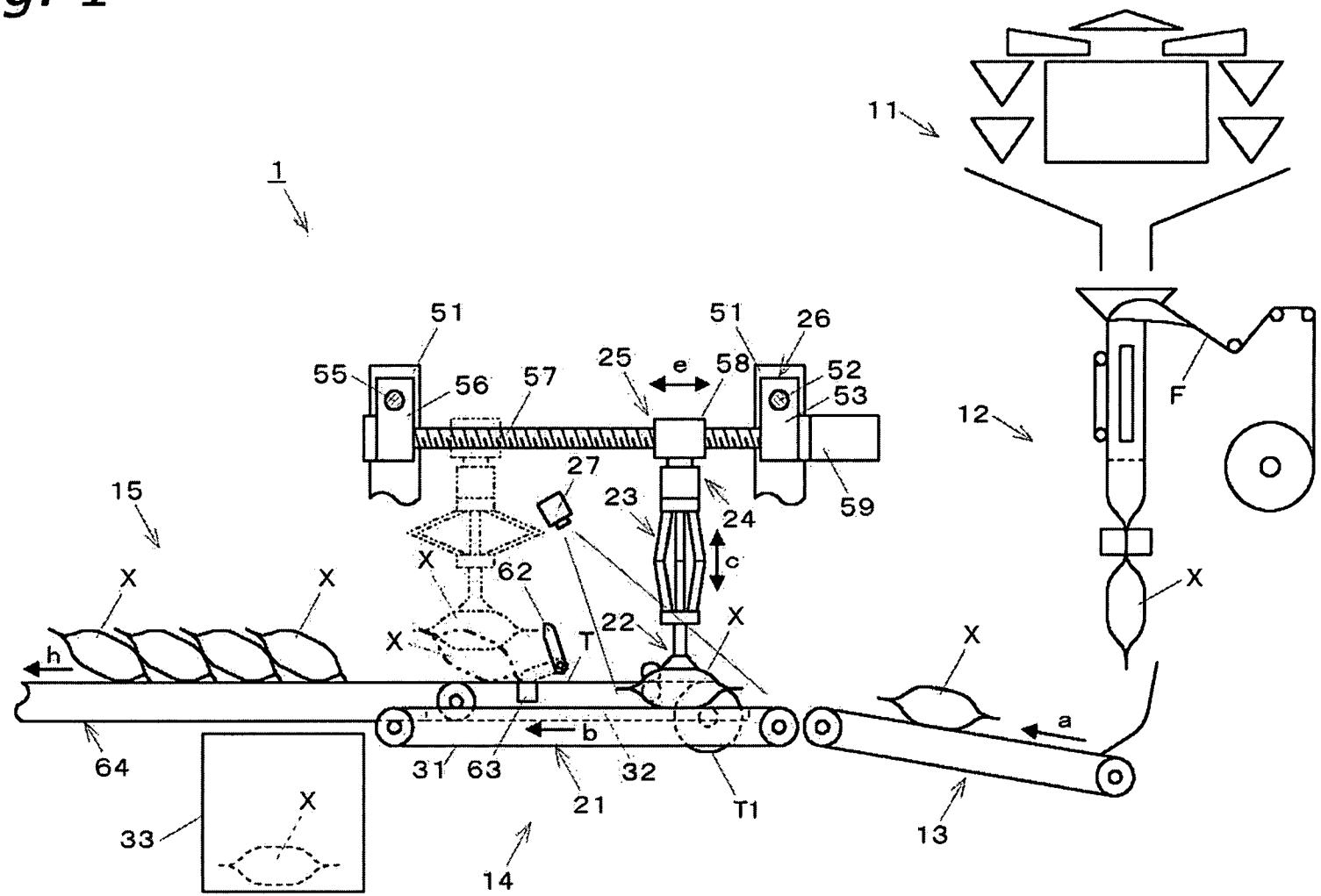
FIG. 1 is a schematic side view of the strip tape mounting system according to the first embodiment of the present invention.

Referring initially to FIG. 1, a tape mounting system is illustrated in accordance with a first embodiment of the present invention.

<Overview of Strip Tape Mounting System>

The present invention is applied to a strip tape mounting system 1. After a seal check and a weight check are performed on a product such that a target weight of contents like potato chips and candies are packaged in a bag, the strip tape mounting system 1 mounts the products on a strip tape as a display medium. As shown in FIG. 1, the strip tape mounting system 1 has, in the order from the upstream side, a combination weigher 11, a bag manufacturing and packaging apparatus 12, a relay conveyor 13, a product inspection apparatus 14, and a strip tape mounting apparatus 15. Furthermore, in the following explanation of the components from the relay conveyor 13 onwards, the term "front-rear direction" means the downstream side and the upstream side of the transfer direction of the products. In addition, "left-right" means the left side and the right side facing the downstream transfer direction.

According to the strip tape mounting system 1, a target weight of the supplied contents is weighed by the combination weigher 11, and is discharged to the bag manufacturing and packaging apparatus 12 located below. In the bag manufacturing and packaging apparatus 12, while the bag is being manufactured by longitudinally and transversely sealing a film F, the contents are sealed in the bag to form a product X. This packaged product X is transported in an arrow a direction by the relay conveyor 13, and is supplied to the product inspection apparatus 14. In the product inspection apparatus 14, a seal check and a weight check are performed on the product X. As a result of both checks, only the products X determined to be normal products are transferred to the strip tape mounting apparatus 15 provided along the product inspection apparatus 14, and are mounted to a strip tape T by the strip tape mounting apparatus 15.

Among the above-mentioned apparatuses, the combination weigher 11, the bag manufacturing and packaging apparatus 12, and the relay conveyor 13 are conventional devices well known to those in the art. Accordingly, further explanation and illustration of these apparatuses will be omitted herein. The following explains the product inspection apparatus 14 in further detail.

<Product Inspection Apparatus>

Figure 2:
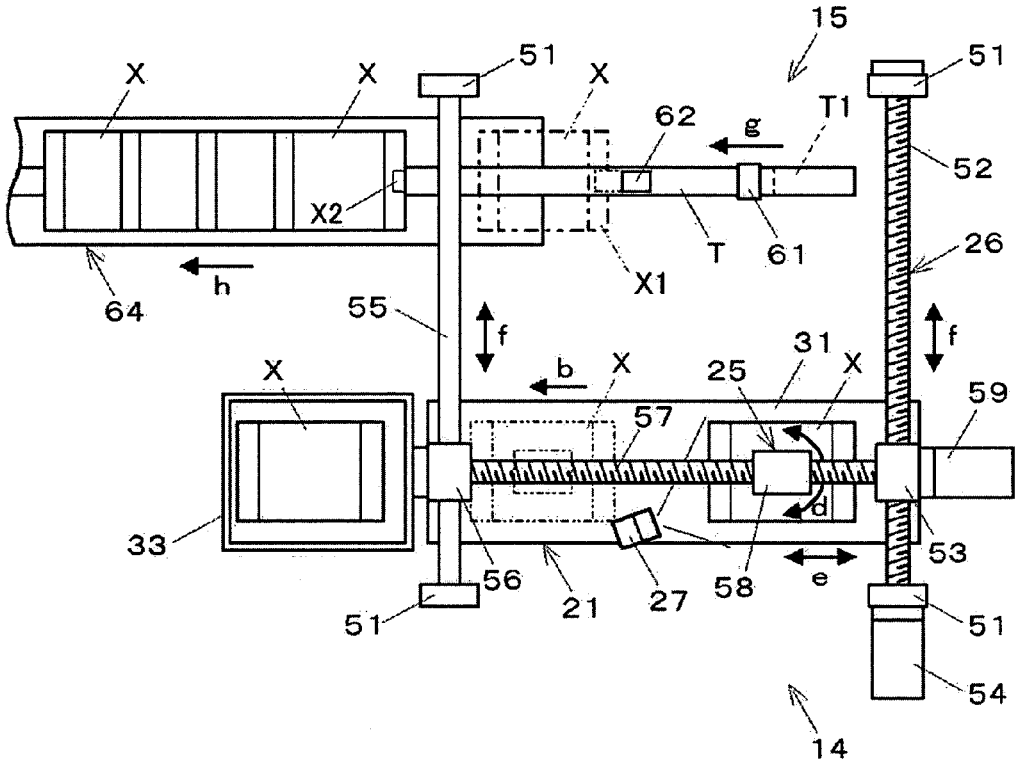
FIG. 2 is a plan view that depicts the strip tape mounting system according to the first embodiment of the present invention.

The product inspection apparatus 14 is structured so as to perform a seal check and a weight check. The product inspection apparatus 14 inspects the seal state based on the pressing reaction force from the product X when the product X is pressed from above during the seal check. In addition, the product inspection apparatus 14 inspects, based on the weight when the product X is pulled up during the weight check, whether the weight of the product X is within a prescribed range. As shown in FIG. 1 and FIG. 2, the product inspection apparatus 14 includes a transport conveyor 21 (an example of a product transport mechanism) that transports direction the product X supplied from the relay conveyor 13 toward the strip tape mounting apparatus 15 in the direction of an arrow b; a holding mechanism (an example of product placing mechanism) 22 located above the transport conveyor 21 and that holds the product X from above; transfer mechanisms 23-26 that transfer that holding mechanism 22; and a CCD (charge coupled devices) camera (an example of imaging means) 27 that images the supplied product X. The transport conveyor 21 is supported by support means, which is no shown in the Figures.

The transport conveyor 21 has a flat belt 31 driven by a motor (not shown); and a support plate 32 that supports the travel surface on the upper side of that flat belt 31. In addition, the downstream end of the transport conveyor 21 is provided with a defective product collection box 33 that collects products X determined to be defective products. The transport conveyor 21 is a conventional component that is well known in the art. Therefore, its structure and function will not be discussed or illustrated in further detail herein.

Figure 3:
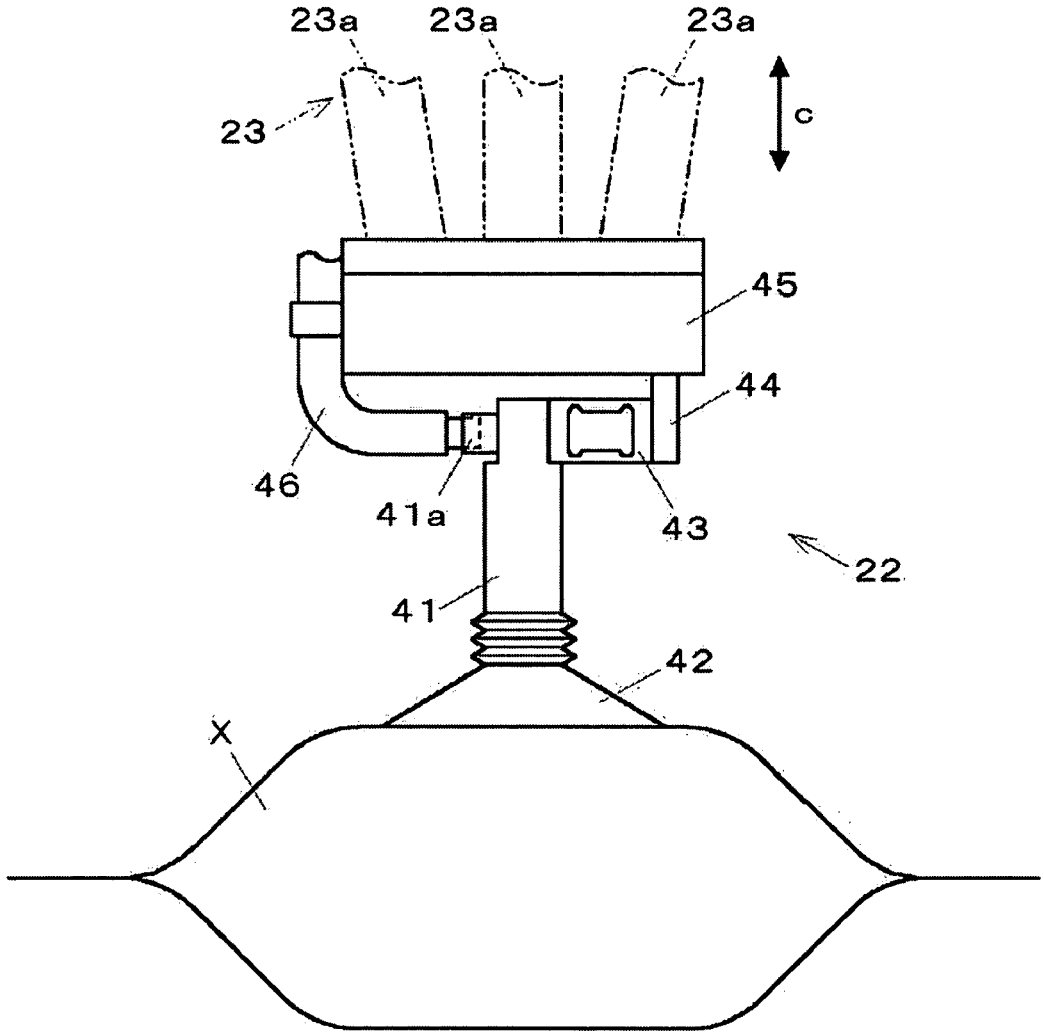
FIG. 3 is an enlarged side view that depicts the holding mechanism according to the first embodiment of the present invention.

As shown in FIG. 3, the holding mechanism 22 is a mechanism that holds the product X by suction, and places the product X onto the carry-out conveyor 64 such that the weld part X2 vertically overlaps the tape T. The holding mechanism 22 has a suction pad 42 at the lower end of the vertical, long pipe 41. The upper end of the pipe 41 is fixedly attached to the free end of a weight detector 43, such as a load cell that detects the pressing reaction force and the weight. The fixed end of the weight detector 43 is fixedly attached to a fixed base 45 via a bracket 44. The weight detector 43 is a conventional component that is well known in the art. Therefore, its structure and function will not be discussed or illustrated in further detail herein.

Further, a suction opening 41 a is provided at the upper part of the pipe 41. In addition, a conduit 46, whose tip is inserted in the suction opening 41*a* in a non-contact state, is supported by the fixed base 45. This conduit 46 is connected to a suction pump and a blower (not shown) via a solenoid valve 47 (refer to FIG. 4), which will be discussed later. The holding and release of the product X by the suction pad 42 is controlled by switching between a suction mode and an air mode by the action of the solenoid valve 47.

The holding mechanism 22 is coupled to the lower end of a vertical transfer mechanism 23 via the fixed base 45. A well-known telescoping-type robot arm type is used for the vertical transfer mechanism 23. As shown in FIG. 1 and FIG. 3, the vertical transfer mechanism 23 uses three arms 23*a* . . . 23*a* that freely extend and contract in the arrow c direction by a drive source such as a motor (not shown). The fixed base 45 is mounted to the bottom ends of these arms 23*a* . . . 23*a*. In addition, as shown in FIG. 1 and FIG. 2, a front-rear transfer mechanism 25 is coupled to the upper end of the arms 23*a* . . . 23*a* via a turning transfer mechanism 24. The turning transfer mechanism 24 is a mechanism that freely turns the vertical transfer mechanism 23 and the holding mechanism 22 in the arrow d direction (refer to FIG. 2) within a horizontal plane. The front-rear transfer mechanism 25 transfers the holding mechanism 22 horizontally in the arrow e direction within the horizontal plane. The vertical transfer mechanism 23, the turning transfer mechanism 24, and the front-rear transfer mechanism 25 thus transfer the holding mechanism 22 toward the strip tape mounting apparatus 15, and are examples of the product transfer mechanism in this embodiment.

The front-rear transfer mechanism 25 and a left-right transfer mechanism 26 are supported by support members 51 . . . 51, which are provided in a standing condition at a prescribed location. The left-right transfer mechanism 26 is a mechanism that is arranged so that it overlaps the strip tape mounting apparatus 15 in the left-right direction as seen in FIG. 2, and transfers the holding mechanism 22 in the arrow f direction. The left-right transfer mechanism 26 has a screw shaft 52, a female screw block 53, a motor 54, a guide rod 55, and a slider 56. The screw shaft 52 is supported freely rotatably between a rear left-right pair of support members 51, 51. The female screw block 53 is screwed into the screw shaft 52, and moves in the arrow f direction by the rotation of the screw shaft 52. The motor 54 is provided on one of the support members 51, and an output shaft of the motor 54 is coupled to the screw shaft 52. The guide rod 55 is supported between a front left-right pair of support members 51, 51. The slider 56 is fitted freely slidably to the guide rod 55.

However, the front-right transfer mechanism 25 has a screw shaft 57, a female screw block 58, and a motor 59. The screw shaft 57 is supported freely rotatably between the female screw block 53 and the slider 56. The female screw block 58 is screwed into the screw shaft 57, and moves in the arrow e direction by the rotation of the screw shaft 57. The motor 59 is provided in the female screw block 53 of the left-right transfer mechanism 26, and an output shaft of the motor 59 is coupled to the screw shaft 57. Further, the holding mechanism 22 is coupled to the female screw block 58 via the turning transfer mechanism 24 and the vertical transfer mechanism 23. Such vertical transfer mechanism, turning transfer mechanism, and front-rear transfer mechanism are conventional components that are well known in the art. Therefore, their structures and functions will not be discussed or illustrated in further detail herein.

The CCD camera 27 is installed at a suitable location of the support member 51 above the transport conveyor 21 so that the products X supplied from the relay conveyor 13 can be detected. Further, the CCD camera 27 detects the plan view shape, dimensions, position, inclination, and the like, of the supplied products X. The CCD camera 27 is a conventional component that is well known in the art. Therefore, its structure and function will not be discussed or illustrated in further detail herein.

<Strip Tape Mounting Apparatus>

The following explains the strip tape mounting apparatus 15.

As shown in FIG. 1 and FIG. 2, the strip tape mounting apparatus 15 is a transverse type that pays out the strip tape T in the horizontal direction as indicated by the arrow g. The strip tape mounting apparatus 15 has a support means (not shown) that supports a tape roll T1, a vertical pair of payout rollers 61, a clamp (an example of the pressing member) 62, a heater block 63, and a carry-out conveyor 64 that is intermittently driven by a drive source such as a motor (not shown). The payout rollers 61 and the carry-out conveyor 64 constitute the tape holding mechanism, which holds the strip tape T substantially horizontally. In addition, the clamp 62 and the heater block 63 constitute the mechanism that mounts the products X to the strip tape T by attaching a part of each of the products X to the strip tape T such that weld part X2 of each of the products X overlaps in the vertical direction on the strip tape T, which is held by the tape holding mechanism in a horizontal state.

The heater block 63 is positioned slightly below the strip tape T, which is held in a horizontal state by the payout rollers 61 and the carry-out conveyor 64, and does not contact the strip tape T until the clamp 62 presses down upon the strip tape T. The heater block 63 is a conventional component that is well known in the art. Therefore, its structure and function will not be discussed or illustrated in further detail herein.

The clamp 62 is pivotally supported by the support member 52 at one end, such that the other end is pivotable about the first end. The control unit 70 controls the clamp 62 such that a motor (not shown) pivots the clamp 62 between the two states shown by the solid line and the chain double-dashed line in FIG. 1 and FIG. 2. Accordingly, the clamp 62 presses the weld part X2 of the product X toward the carry-out conveyor 64. In addition, when in the state shown by the chain double-dashed line in FIG. 1 and FIG. 2, the clamp 62 presses strongly against the heater block 63 such that the weld part X2 of the product X and the strip tape T vertically overlap. In other words, the strip tape mounting apparatus 15 sandwiches the weld part X2 of the product X and the strip tape T between the clamp 62 and the heater block 63, and welds them together. The strip tape T and the product X, in which a weld part X2 shown in FIG. 2 is formed and which forms an integrated unit, is transferred further downstream by the carry-out conveyor 64, as shown by the arrow h.

Furthermore, the feed pitch of the intermittently driven carry-out conveyor 64 and the payout rollers 61 is controlled based on a signal from a detection apparatus (not shown) that detects registration marks printed on the strip tape T. Such detection apparatus is a conventional component that is well known in the art. Therefore, its structure and function will not be discussed or illustrated in further detail herein.

<Strip Tape Mounting System Control>

The following explains the control performed by the strip tape mounting system 1.

Figure 4:
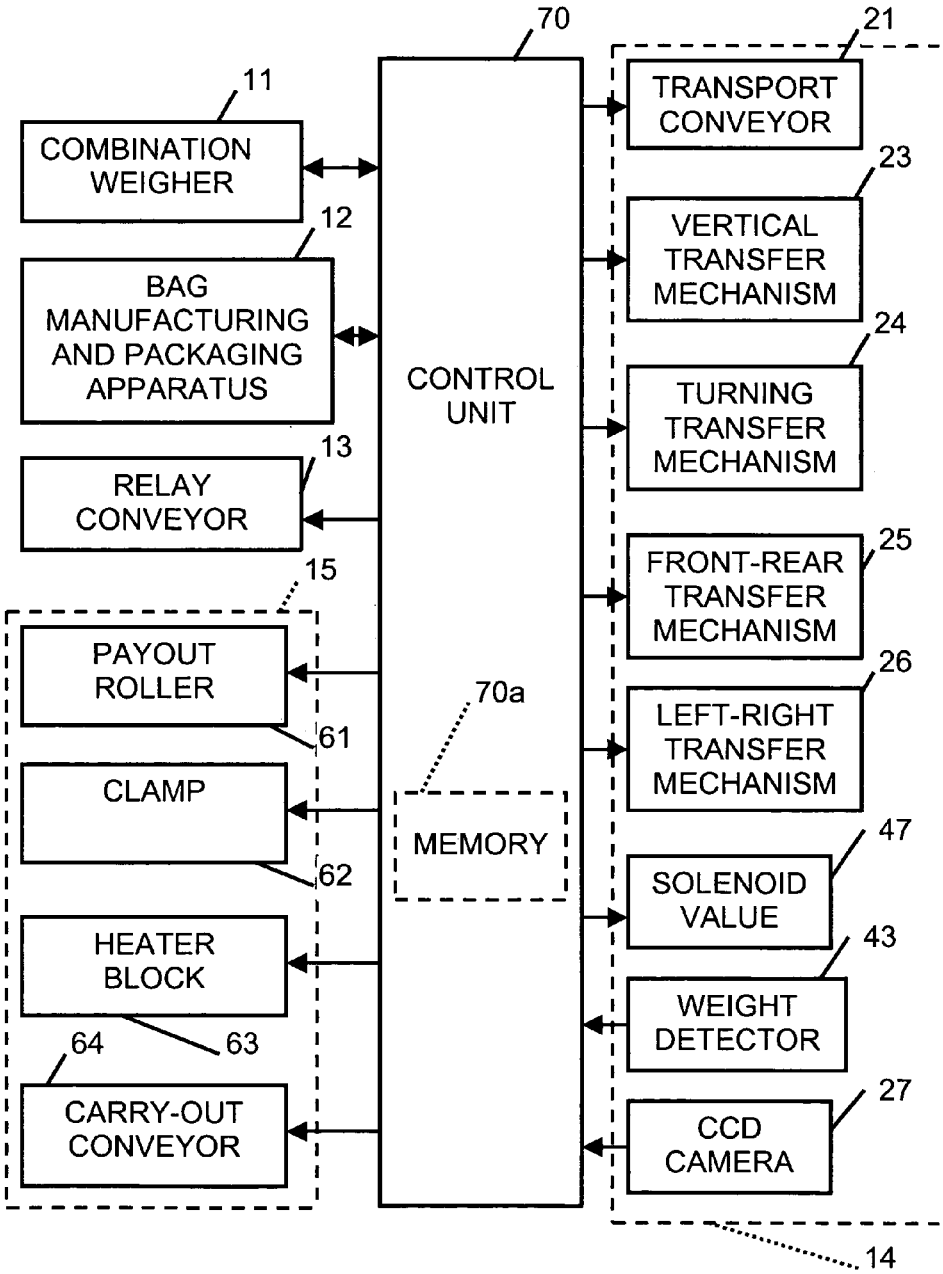
FIG. 4 is a control block diagram according to the first embodiment of the present invention.

As shown in FIG. 4, a control unit 70 that comprehensively controls the strip tape mounting system 1 is operatively connected to the combination weigher 11 and the bag manufacturing and packaging apparatus 12 to receive signals therefrom. The control unit 70 is also operatively connected to various components of the product inspection apparatus 14 and the strip tape mounting apparatus 15. The control unit 70 preferably includes a microcomputer with a control program that controls the relay conveyor 13, the transport conveyor 21 of the product inspection apparatus 14, the vertical transfer mechanism 23, the turning transfer mechanism 24, the front-rear transfer mechanism 25, the left-right transfer mechanism 26, and the solenoid valve 47 as discussed below. The control unit 70 is capable of selectively controlling any of the components operatively connected thereto in accordance with the control program. It will be apparent to those skilled in the art from this disclosure that the precise structure and algorithms for the control unit 70 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

The control unit 70 can also include other conventional components such as an input interface circuit, an output interface circuit, and storage devices such as a ROM (Read Only Memory) device and a RAM (Random Access Memory) device.

In addition, the control unit 70 outputs a control signal to the relay conveyor 13, the transport conveyor 21 of the product inspection apparatus 14, the vertical transfer mechanism 23, the turning transfer mechanism 24, the front-rear transfer mechanism 25, the left-right transfer mechanism 26, and the solenoid valve 47 that operates the suction pad 42. Furthermore, the control unit 70 receives a detection signal from the weight detector 43 and the CCD camera 27.

Furthermore, the control unit 70 executes a seal determination and a weight determination based on weight signals detected by the weight detector 43 during the weight check and signals relating to the pressing reaction force detected during the seal check and the product weight. Based on these determination results, the control unit 70 controls the drives of each of the abovementioned transfer mechanisms 23-26 so that the products X are sorted into normal products and defective products. In addition, the control unit 70 controls the drives of each of the transfer mechanisms 23-26 based on the inputted signals that are detected by the CCD camera 27 and relate to the plan view shape, dimensions, position, inclination, and the like of the product X.

Furthermore, the control unit 70 outputs control signals to the payout rollers 61, the clamp 62, the heater block 63, and the carry-out conveyor 64 of the strip tape mounting apparatus 15.

A memory 70*a* of the control unit 70 stores, by product code, parameters for control, such as the product name, the bag dimensions, the weight criteria, the internal pressure criteria, the transfer stroke of each of the transfer mechanisms 23-26, the transfer speed of the transport conveyor 21, and the transport pattern of the carry-out conveyor 64. It is constituted so that the various settings are executed in the control unit 70 by specifying a product code.

<Operation of the Strip Tape Mounting System>

The following explains the mode of operation of the strip tape mounting system in accordance with the present embodiment.

First, the contents weighed to the target weight by the combination weigher 11 is made into a packaged product X by the bag manufacturing and packaging apparatus 12, and is then supplied to the product inspection apparatus 14 via the relay conveyor 13.

When a product X is detected by the CCD camera 27 provided in the product inspection apparatus 14, the control unit 70 recognizes the shape, dimensions, position, inclination, and the like, of that product X based on that detection signal, whereupon the control unit 70 outputs a control signal to each of the transfer mechanisms 23-26. Based on these control signals, the suction pad 42 of the holding mechanism 22 moves so that it captures the center of the surface of the product X.

As shown by the solid line in FIG. 1, the arms 23*a* . . . 23*a* of the vertical transfer mechanism 23 extend by at least to a prescribed stroke, and the suction pad 42 coupled via the pipe 41 to the lower end of the arms 23*a* . . . 23*a* reaches the product X, whereupon the solenoid valve 47 operates so as to start suction of the air through the pipe 41. Thereupon, the suction pad 42 holds the product X by suction, and presses the product X against the support plate 32 via the flat belt 31, thereby performing the seal check. Furthermore, during the pressing, i.e., during the seal check, the drive of the front-rear transfer mechanism 25 is controlled by the control unit 70 so that the holding mechanism 22 and the transport conveyor 21 can work together to transport the product X.

Figure 5:
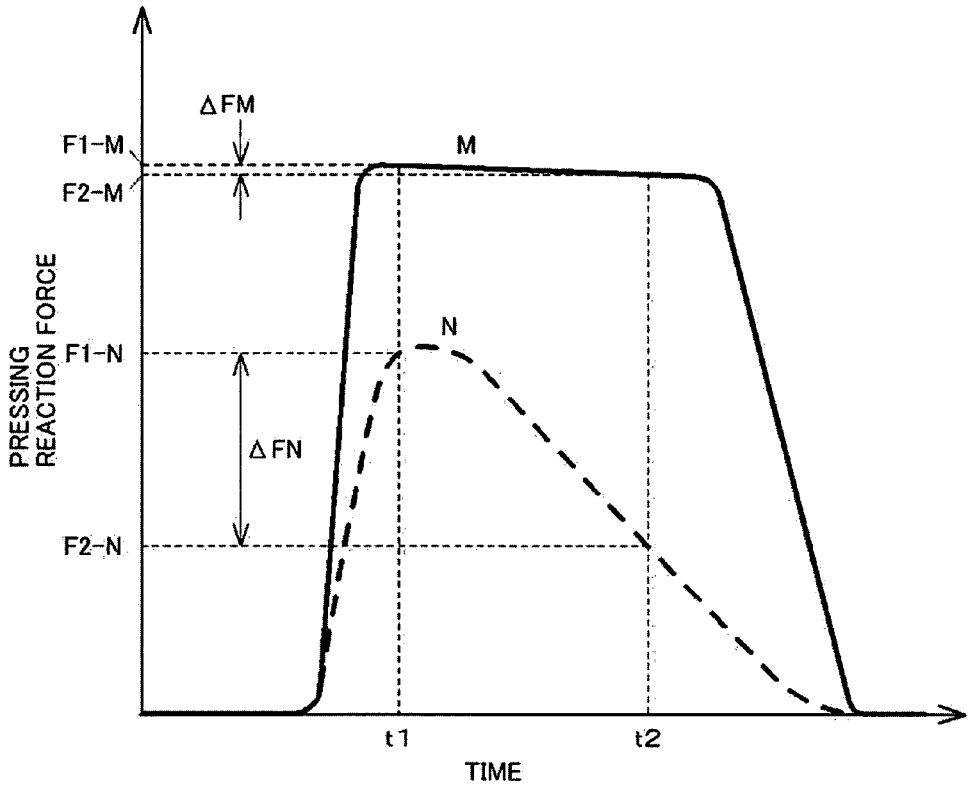
FIG. 5 is a graph that depicts one example of the time variation of the pressing reaction force during the seal check according to the first embodiment of the present invention.

During the interval of the seal check, the pressing reaction force from the product X is applied to the weight detector 43 via the suction pad 42. As illustrated in FIG. 5, in the case of a product X whose pressing reactionary force is depicted as (1) in the figure, the pressing reactionary force rises rapidly after pressing commencement, then maintains a substantially fixed value during the seal check, and then rapidly decreases when the seal check is completed and the product X is released from the pressing. In contrast, in the case of a product X whose pressing reactionary force is depicted as (2) in the figure, the pressing reactionary force rises rapidly after pressing commencement but, unable to withstand the pressing, the gas, such as air or an inactive gas, is discharged from inside the bag of the product X, and the pressing reactionary force suddenly decreases.

The seal propriety is determined based on the amount of change in the pressing reactionary force at the data read start time t1 and at the data read end time t2. Namely, in the case of a product X depicted by the symbol (1), since the amount of change in the pressing reactionary force ΔF(1) between the pressing reactionary force F1(1) at the data read start time t1 and the pressing reactionary force F2(1) at the data read end time t2 is smaller than the reference amount of change, which is stored in the memory 70*a* beforehand, the product X is determined to be a normal product. However, in the case of a product X depicted by the symbol (2), since the amount of change in the pressing reactionary force ΔF(2) between the pressing reactionary force F1 (2) at the data read start time t1 and the pressing reactionary force F2(2) at the data read end time t2 is larger than the reference amount of change, the product X is determined to be a defective product.

Furthermore, unlike the method discussed earlier, it is also acceptable to perform the seal judgment based on the pressing reaction force at the data read end time t2. In the case of a product X shown by the symbol (1) in the illustrated example, since the pressing reactionary force F2(1) at the data read end time t2 is larger than a reference pressing reaction force, which is stored in the memory 70*a* beforehand, the product X is determined to be a normal product. However, in the case of a product X depicted by the symbol N, since the pressing reactionary force F2(2) at the data read end time t2 is smaller than the reference pressing reactionary force, the product X is determined to be a defective product.

When the seal check ends, the arms 23*a* . . . 23*a* of the vertical transfer mechanism 23 contract, as shown by the thin chain double-dashed line in FIG. 1 and FIG. 2. At that time, if the control unit 70 determines the relevant product X to be a defective product based on the previously discussed seal propriety determination, then the control unit 70 controls the operation of the solenoid valve 47 so that the product X is released from the suction of the suction pad 42, and the product X returns onto the transport conveyor 21. Thus, the product X that is returned to the transport conveyor 21 is transported in the arrow b direction by the transport conveyor 21, and is collected in the defective product collection box 33. However, if the control unit 70 determines the product X to be a normal product, then the product X is lifted up from the transport conveyor 21 by suction to the suction pad 42, and the product X is transferred to the strip tape mounting apparatus 15.

When the product X is lifted up from the transport conveyor 21, the weight of the product X is detected by the weight detector 43 via the suction pad 42. When the control unit 70 inputs the weight signal detected from the weight detector 43, a determination is made as to whether that weight is within a prescribed weight range, which is the reference weight of the product X previously stored in the memory 70*a*. If, as a result of this weight check, the control unit 70 determines the product X to be a defective product, then the product X is once again transferred to the transport conveyor 21 by the left-right transfer mechanism 26, the product X is released from the suction of the suction pad 42, and returns to the transport conveyor 21. Thus, the product X that returned to the transport conveyor 21 is transported in the arrow b direction by the transport conveyor 21, and is collected in the defective product collection box 33.

However, if, as a result of the weight check, the control unit 70 determines the product X to be a normal product, then the left-right transfer mechanism 26 transfers the product X to the strip tape mounting apparatus 15. When the transverse seal part X1 of the product X that is transferred to this transverse-type strip tape mounting apparatus 15, the transverse seal part X1 is placed between the heater block 63 and the clamp 62, as the arms 23*a* . . . 23*a* of the vertical transfer mechanism 23 extend by at least a prescribed stroke. The control unit 70 controls the clamp 62 to pivot as shown by the solid line and the chain double-dashed line in FIG. 1 and FIG. 2 so as to synchronize with the operation of the transfer mechanisms 23-26. Furthermore, when the clamp 62 is pressed to the heater block 63, the transverse seal part X1 of the product X and the strip tape T are sandwiched and welded together. During welding, the product X is released from the suction of the suction pad 42. Furthermore, the carry-out conveyor 64 is driven so that it moves by at least a prescribed distance in the arrow h direction, and the strip tape mounting apparatus 15 stands by in preparation for the next welding of a product X to the strip tape T.

On the other hand, the suction pad 42 is lifted up by the drive of each of the transfer mechanisms 23-26, and heads toward holding of the next product X supplied by the relay conveyor 13.

<Characteristics of the Strip Tape Mounting System>

(1) The inclination and the spacing in the horizontal plane of the products X supplied from the relay conveyor 13 are not necessarily constant. However, since the control unit 70 controls the operation of each of the transfer mechanisms 23-26 after recognizing the shape, dimensions, position, inclination, and the like of the products X based on the detection signal from the CCD camera 27 disposed within the product inspection apparatus 14, the holding mechanism 22 reliably captures the product X without having to rely on, for example, the use of a guide member that corrects the inclination of the products X.

Figure 6:
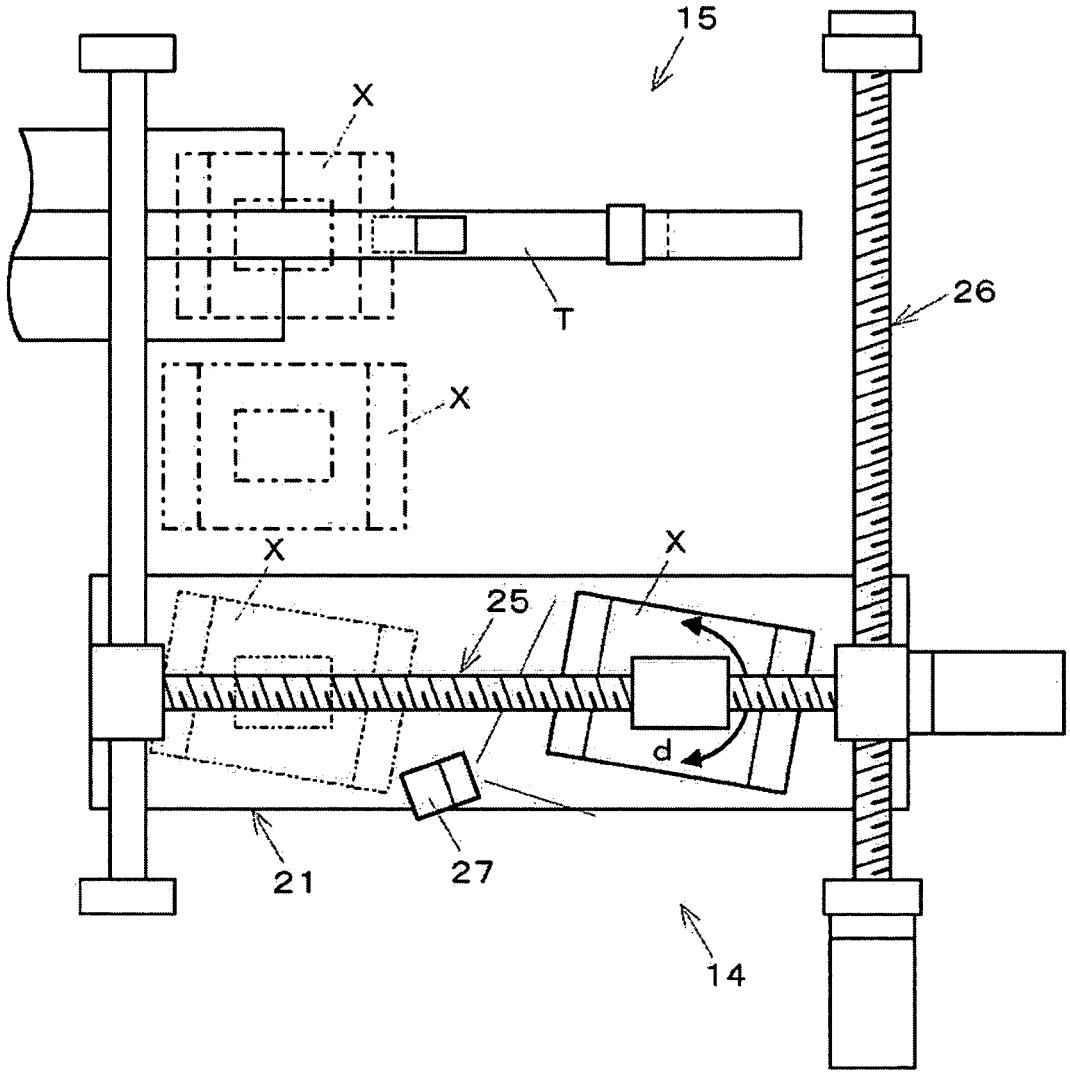
FIG. 6 is a plan view of the strip tape mounting system according to the first embodiment of the present invention, showing one example of correction of the inclination of the product.

In addition, if based on the detection results of the CCD camera 27, then the holding mechanism 22 can aim at the center of the surface of the product X and can capture the product X even if the product X is supplied to the transport conveyor 21 of the product inspection apparatus 14 in tilted orientations as shown by, for example, the solid line in FIG. 6. Further, because the turning transfer mechanism 24 is disposed for turning the holding mechanism 22 that holds the product X in a direction as shown by the arrow d, the tilting of the product X after the seal check, as shown by the thin chain double-dashed line, can be corrected to a prescribed orientation, as shown by the thick chain double-dashed line, during the transfer of the product X to the strip tape mounting apparatus 15. As a result, in the strip tape mounting apparatus 15, the product X can maintain a proper mounting orientation with respect to the strip tape T, as shown by the thick chain double-dashed line.

In addition, the holding mechanism 22 can hold the center of the surface (or the weight center) of the product X and can therefore hold the product X in a stable orientation even while the product X is in the middle of being transferred by the front-rear transfer mechanism 25 or the left-right transfer mechanism 26 while being held. As a result, not only can dropping of the product X from the holding mechanism 22 be prevented, but a stabilized detection signal can be output from the weight detector 43, which improves the accuracy of the seal check and weight check.

(2) Although the product inspection apparatus 14 is a single apparatus, it is capable of performing both a seal check and a weight check. Consequently, this also naturally speeds up the processing of products in the strip tape mounting system 1 and makes the strip tape mounting system 1 more compact. Furthermore, because the product inspection apparatus 14 has the transfer mechanisms 23-26 that transfer the holding mechanism 22, there is a greater variety in holding modes and transfer modes of the products X. In other words, the ability of the holding mechanism 22 to freely press the product X from above and to freely lift up the product X facilitates the implementation of the seal check and the weight check.

Furthermore, moving the holding mechanism 22 by the operation of each of the transfer mechanisms 23-26 improves the flexibility in the way products X are received from the relay conveyor 13 on the upstream side, the way products X are transferred within the product inspection apparatus 14, the way products X are handed over to the strip tape mounting apparatus 15 on the downstream side, the way inclination of the products X are corrected within the horizontal plane, and the like. Accordingly, it is possible to implement a product inspection apparatus 14 that is flexibly adaptable to peripheral equipments such as the relay conveyor 13, as well as the bag manufacturing and packaging apparatus 12, and the strip tape mounting apparatus 15.

In addition, because the holding mechanism 22 is constituted so that it holds a product X by suction via the suction pad 42, it has a relatively simplified construction, which in turn avoids unnecessary cost increases.

In addition, because only products X that are determined to be normal products are transferred from the product inspection apparatus 14 to the strip tape mounting apparatus 15 on the downstream side, mounting of defective products to the strip tape T is avoided, and processing efficiency of the products in the strip tape mounting apparatus 15 is improved.

(3) Because the strip tape mounting apparatus 15 is of a transverse type and pays out the strip tape T in the horizontal direction, barely any of the weight of a product X itself is borne by the weld part X2. Consequently, products X are not likely to fall off the strip tape T after welding. Such advantage is particularly effective in the case of a product X in which the contents are heavy. Namely, in the strip tape mounting system 1, the strip tape T is held in a horizontal state, and the product X is mounted to the strip tape T in a state wherein the transverse seal part X1 of the product X and the strip tape T overlap in the vertical direction. Consequently, this reduces the risk that the relative position of the product X and the strip tape T undesirably deviates from a stipulated state during mounting of the product X to the strip tape T. Thus, herein, by mounting products X to the strip tape T that laid horizontally with a portion of the products X overlapping with the strip tape T in the vertical direction, it is possible to reduce deviation in the mounting position of the product X with respect to the strip tape T due to positional deviation of the strip tape T.

In particular, in the present system, since the strip tape T is made of a material that is more flexible than a material of which the sheet F is made, the holding of the strip tape T by the strip tape mounting apparatus 15 in the horizontal state instead of the vertical state is extremely effective in reducing the problem of left-right positional deviation of the strip tape T before or when mounting the products X to the strip tape T.

(4) In the strip tape mounting system 1, the planar positions of the transport conveyor 21 and the carry-out conveyor 64 are significantly displaced, as shown in FIG. 2. Further, the vertical transfer mechanism 23 and the left-right transfer mechanism 26 are disposed in order to transfer the products X on the transport conveyor 21 to the carry-out conveyor 64. Because these transfer mechanisms are structured such that the products X are transferred to the strip tape mounting apparatus 15 and overlap in the vertical direction with the strip tape T, which is held in a horizontal state in the strip tape mounting apparatus 15, there are practically no failures in mounting products X to the strip tape T in the strip tape mounting system 1.

In addition, because the transport conveyor 21 and the carry-out conveyor 64 are spaced apart in the width direction, the tape roll T1, the payout rollers 61, the clamp 62, the heater block 63, and the like, all of which need to be arranged near the carry-out conveyor 64, can be designed and arranged practically without taking into account interference with the transport conveyor 21. Consequently, the degrees of freedom in the design of the strip tape mounting apparatus 15 is high, and the structure of the strip tape mounting apparatus 15 is simplified.

<Modified Example of the First Embodiment>

(A)

If the control unit 70 receives, from an upstream side device such as the combination weigher 11 or the bag manufacturing and packaging apparatus 12, an error signal such as a 0-point error signal, an over supply error signal, or a packaging error signal, then each of the product X inspections in the product inspection apparatus 14 may be inhibited. In other words, control may be performed so that the operation of each of the transfer mechanisms 23-26 is inhibited, and that a product X that is supplied to the product inspection apparatus 14 is not held by the holding mechanism 22, but is transported on the transport conveyor 21 and collected in the defective product collection box 33. Thereby, each of the transfer mechanisms 23-26 is no longer wastefully driven.

(B)

The control unit 70 may be configured to compare the weight signal output from the combination weigher 11, which is on the upstream side, and the detection signal, which is output from the weight detector 43 during the weight check of the product X and corresponds to that weight signal, the control unit 70 may verify the matching of both signals.

(C)

It is also acceptable to configure the control unit 70 to perform a 0-point adjustment of the weight detector 43 when the holding mechanism 22 is not holding a product X and is in a no-load state.

Second Embodiment

The strip tape mounting system according to the second embodiment of the present invention will now be explained. Furthermore, the same symbols will be used for elements that are similar to those in the abovementioned first embodiment, to the extent that it does not invite confusion.

Figure 7:
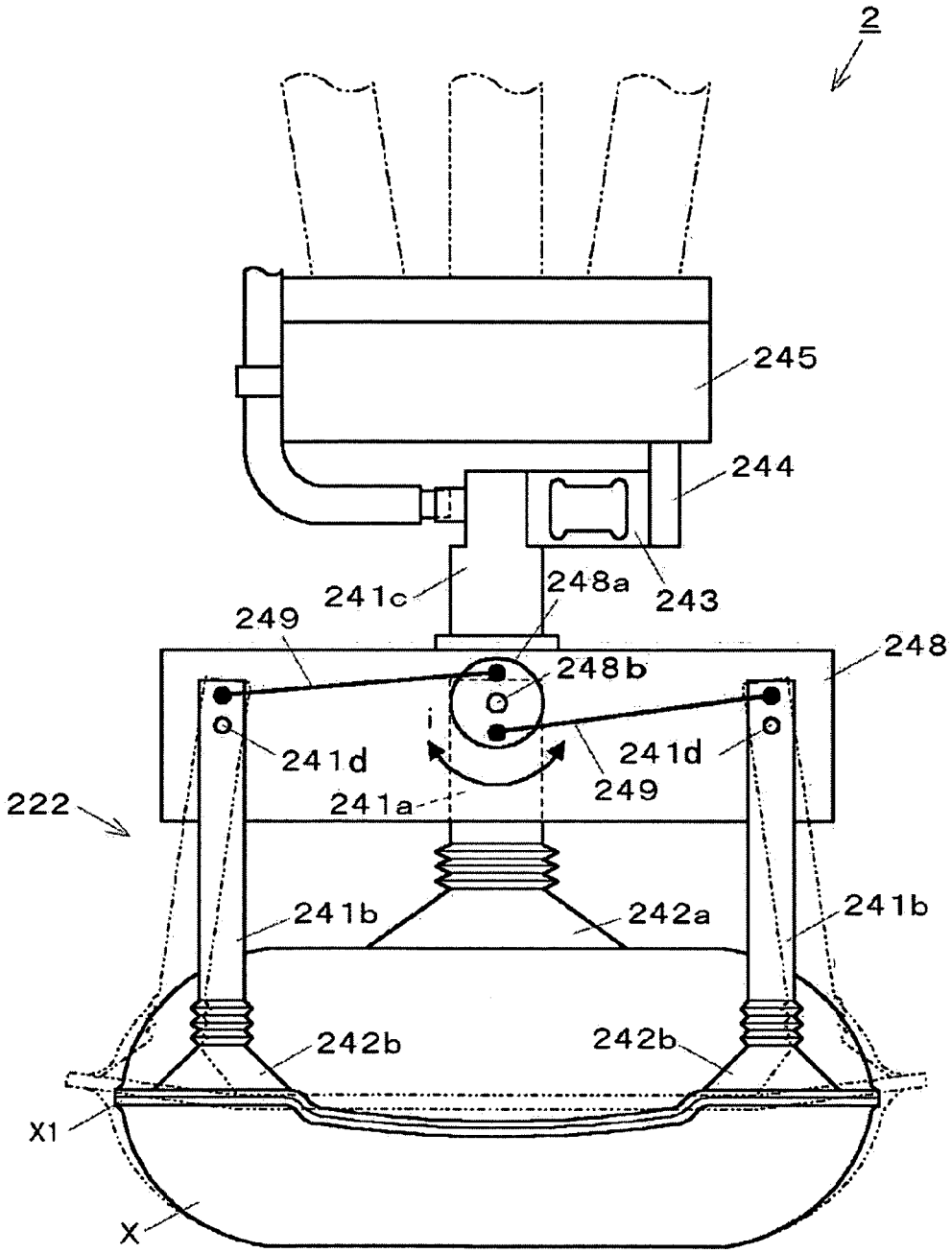
FIG. 7 is a front view of the holding mechanism of the strip tape mounting system according to the second embodiment of the present invention.

As shown by the extraction of the principle part in FIG. 7, the strip tape mounting system 2 is modified in that the holding mechanism 222 is constituted differently from the holding mechanism 22 of the first embodiment.

The holding mechanism 222 has, at the lower ends of three vertical, long sub-pipes 241*a*, 241*b*, 241*b*, suction pads 242*a*, 242*b*, 242*b*, respectively. The upper ends of the sub-pipes 241*a*, 241*b*, 241*b* are attached to the lower end of a main pipe 241*c* via a mount 248. In addition, the two sub-pipes 241*b*, 241*b* arranged on the left and right in FIG. 7 are supported by the mount 248 capable of being swung around spindles 241*d*, 241*d*.

The upper end of the main pipe 241*c* is fixedly coupled to the free end of a weight detector 243, such as a load cell that detects the pressing reaction force end weight. In addition, the fixed end of the weight detector 243 is fixedly coupled to a fixed base 245 via a bracket 244.

Figure 8:
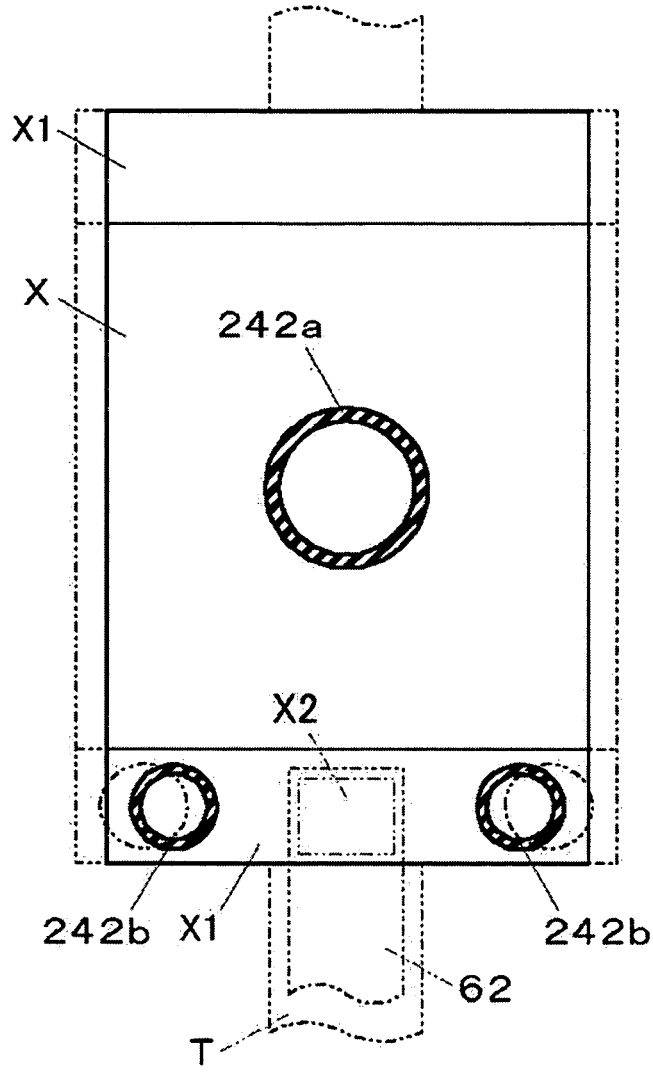
FIG. 8 is a plan view of the holding mechanism according to the second embodiment of the present invention, showing the operation of the holding mechanism.

As shown in FIG. 7 and FIG. 8, the suction pad 242*a*, which is the largest pad among the three suction pads 242*a*, 242*b*, 242*b*, holds products X, the same as the suction pad 42. The suction pad 242*a* is arranged so that it principally holds the center of the surface of the products X by suction. However, the remaining comparatively small two suction pads 242*b*, 242*b* are arranged so that they hold in the vicinity of both ends of one of the transverse seal parts X1 of the product X by suction. The sub-pipe 241*a* which corresponds to the suction pad 242*a* is configured to hold the center of the surface of the product X, and consequently is designed to have a shorter dimension than other sub 241*b*.

In addition, a rotary member 248*a* is provided substantially at the center of the mount 248. The rotary member 248*a* rotates, as depicted by the arrow i, about a spindle 248*b* by means of a rotary solenoid and the like (not shown). In addition, the upper ends of the rotary member 248*a* and the two sub-pipes 241*b*, 241*b* are respectively coupled to linking members 249, 249.

When the rotary member 248*a* is rotated in a prescribed direction, the two sub pipes 241*b*, 241*b* swing around the spindles 241*d*, 241*d*, as shown by the chain double-dashed line in FIG. 7 and FIG. 8, and the spacing between the suction pads 242*b*, 242*b*, which hold by suction the vicinity of both ends of one of the transverse seal parts X1 of the product X, expands. In other words, when the rotary member 248*a* is rotated in a prescribed direction, the transverse seal part X1 expands in the transverse direction. Thereby, wrinkles, slack, and the like are eliminated, and the transverse seal part X1 and the strip tape T make appropriate contact when the product X is mounted to the strip tape T. As a result, the clamp 62 and the heater block 63 (See FIG. 1) solidly form the weld part X2 as shown in FIG. 8, and reliability of mounting the products X to the strip tape T increases. Furthermore, problems such as products X falling off the strip tape T are avoided.

Third Embodiment

The strip tape mounting system according to the third embodiment of the present invention will now be explained. Furthermore, the same symbols will be used for elements that are similar to those in the abovementioned first embodiment, to the extent that it does not invite confusion.

Figure 9A:
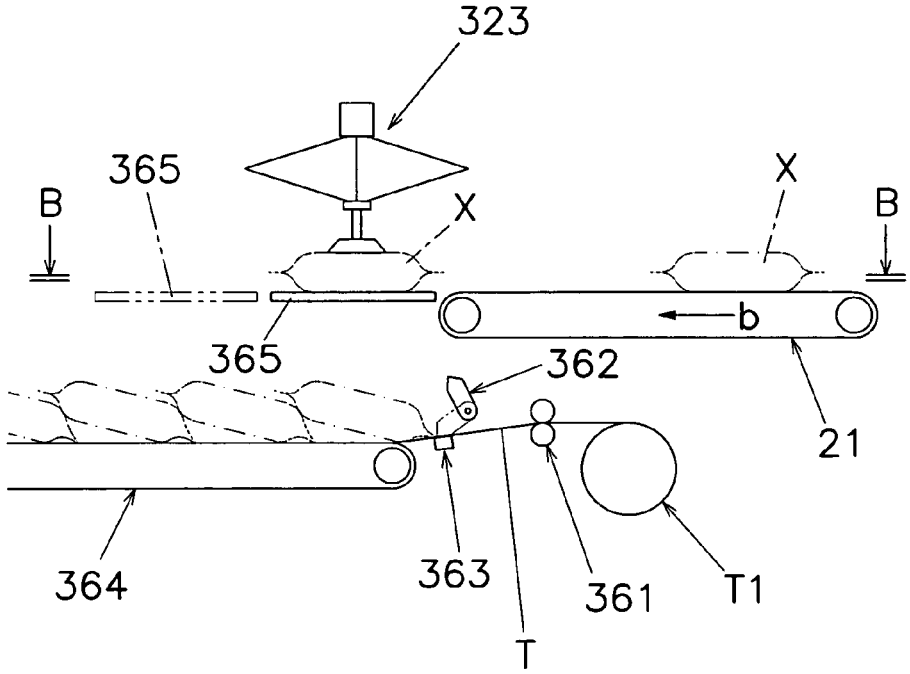
FIG. 9(A) is a side view of the strip tape mounting system according to the third embodiment of the present invention.
Figure 9B:
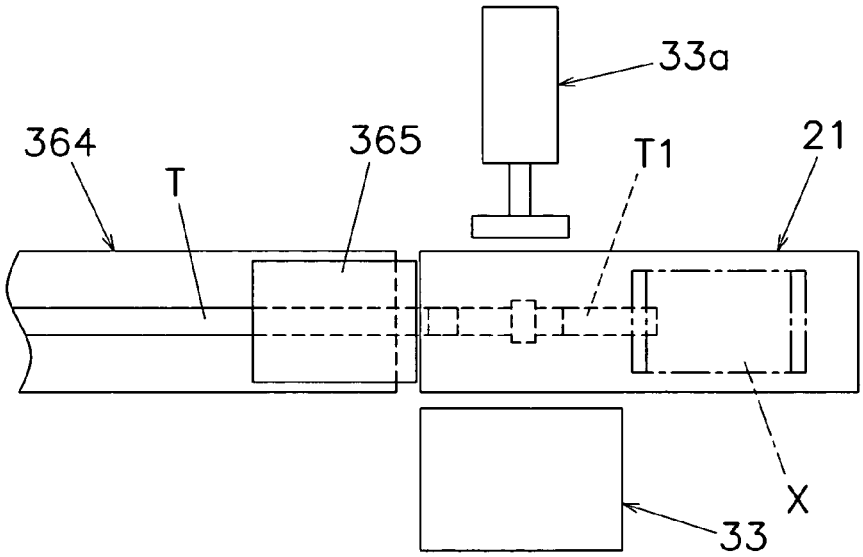
FIG. 9(B) is a plan view of the strip tape mounting system according to the third embodiment of the present invention.

As shown in FIG. 9(A) and FIG. 9(B), a carry-out conveyor 364, which is arranged in a linearly extended manner from the transport conveyor 21, is used instead of the carry-out conveyor 64, which is spaced apart from the transport conveyor 21 in the width direction. In other words, the transport conveyor 21 and the carry-out conveyor 364 are arrayed in a straight line in a plan view as shown in FIG. 9(B). However, the carry-out conveyor 364 is spaced apart from the transport conveyor 21 in the vertical direction, as shown in FIG. 9(A), and is arranged at a location lower than the transport conveyor 21.

Further, a vertical pair of payout rollers 361, which hold the carry-out conveyor 364 as well as the strip tape T substantially horizontally, and a tape roll are arranged in the space below the transport conveyor 21. In addition, a clamp 362 and a heater block 363, which sandwich the strip tape T and the product X and weld them together by heat and pressure, are also arranged in the space below the transport conveyor 21. Furthermore, the payout rollers 361, the tape roll T1, the clamp 362, and the heater block 363 are arranged at substantially the same height as the carry-out conveyor 364, as shown in FIG. 9(A).

In addition, a horizontal sliding member 365 is disposed in front of the transport conveyor 21 and a vertical transfer mechanism 323 that is the same as the vertical transfer mechanism 23 of the first embodiment is disposed above that horizontal sliding member 365. The vertical transfer mechanism 323 is an example of the product transfer mechanism in this embodiment.

Furthermore, herein, the defective product collection box 33 is disposed on the left side of a part close to the tip of the transport conveyor 21. Also, a pusher 33*a*, for dropping products X determined to be defective products into the defective product collection box 33, is arranged at a position opposite the defective product collection box 33, such that the pusher 33*a* and the defective product collection box 33 interpose the transport conveyor 21.

The following explains the operation of the strip tape mounting system of the present embodiment.

The products X transported by the transport conveyor 21 onto the horizontal sliding member 365, shown by the solid line in FIG. 9(A), are held by suction by the vertical transfer mechanism 323. Subsequently, the horizontal sliding member 365 moves frontward by a drive apparatus (not shown) as shown in the horizontal sliding member 365 shown by the chain double-dashed line in FIG. 9(A), and the vertical transfer mechanism 323 that held the product X by suction drops the product X downward to the carry-out conveyor 364. Upon doing so, the clamp 362, which pivots as shown by the solid line and the chain double-dashed line in FIG. 9(A), and the heater block 363 interpose the transverse seal part of the product X and the strip tape T, thus welding the transverse seal part of the product X and the strip tape T. During the welding, the holding by suction of the product X by the vertical transfer mechanism 323 is released. Subsequently, the carry-out conveyor 364 moves by at least a predetermined distance, and stands by to allow the next product X to be welded to the strip tape T.

In the strip tape mounting system of the present embodiment also, the strip tape T is paid out in the horizontal direction, and the strip tape T is held in a horizontal state. Further, the mounting of the products X to the strip tape T is performed in a state wherein the transverse seal parts of the products X vertically overlap with the strip tape T. Consequently, this reduces the risk that the relative position of the product X and the strip tape T during mounting will undesirably deviate from the stipulated state. In addition, the welded part of the product X and the strip tape T bear practically none of the weight of the product X itself, and the product X is not likely to fall off the strip tape T after the welding.

Fourth Embodiment

Figure 10A:
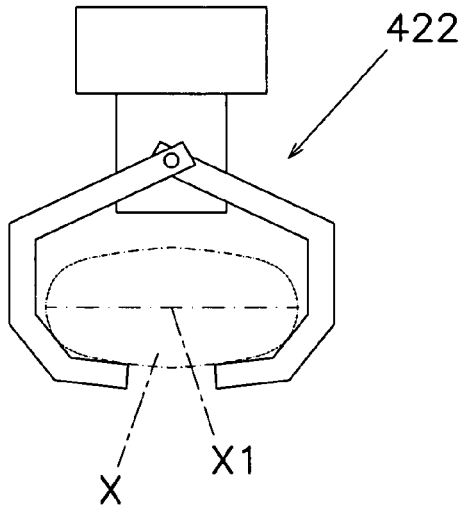
FIG. 10(A) is an enlarged side view of the holding mechanism of the strip tape mounting system according to the fourth embodiment of the present invention.
Figure 10B:
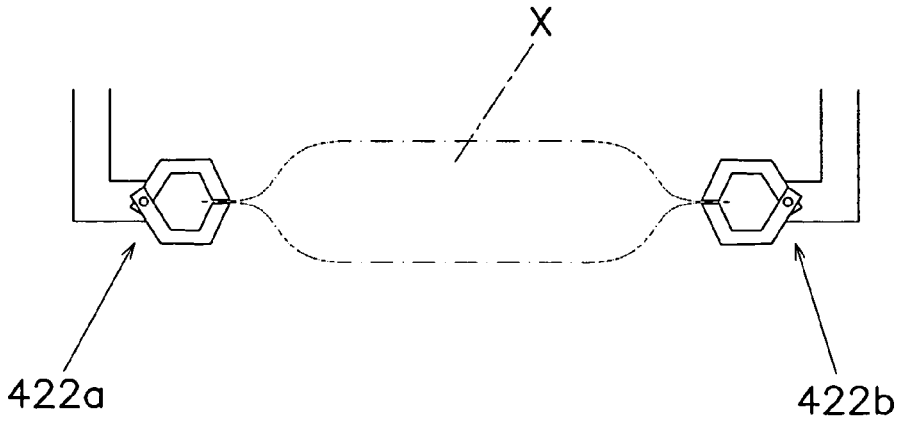
FIG. 10(B) is an enlarged side view of the holding mechanism of the strip tape mounting system according to the fourth embodiment of the present invention.

In the abovementioned first embodiment, the holding mechanism 22 which is of a type that holds the product X by suction is used, and the suction pad 42 holds a product X. As a substitute thereof, a holding mechanism that is provided with a chuck 422 that grasps the entire product X as shown in FIG. 10(A) may be used, and a holding mechanism provided with grasping members 422*a*, 422*b* that grasp the four comers of the product X may be used as shown in FIG. 10(B).

Fifth Embodiment

The strip tape mounting system according to the fifth embodiment of the present invention will now be explained. Furthermore, the same symbols will be used for constituent elements that are similar to those the abovementioned first embodiment, to the extent that it does not invite confusion.

Figure 11A:
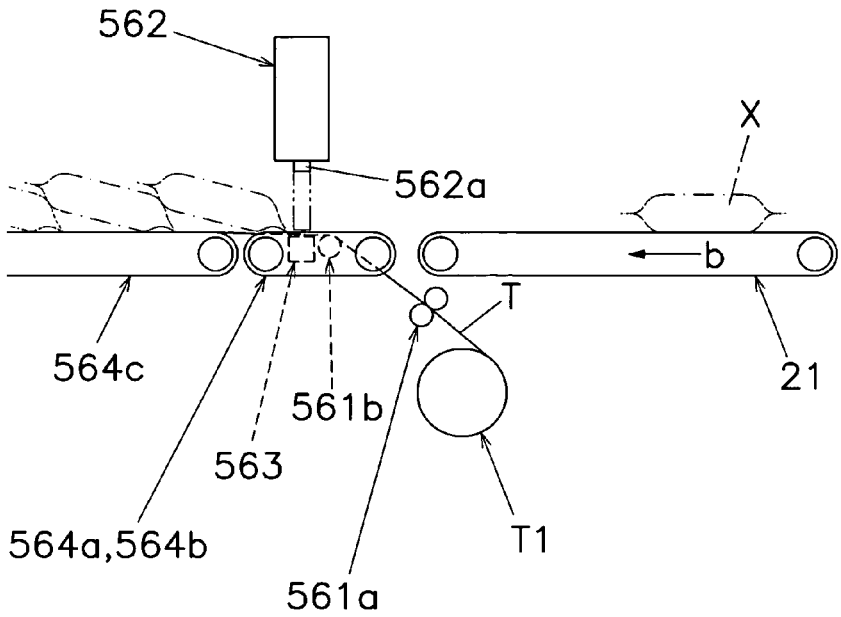
FIG. 11(A) is a side view of the strip tape mounting system according to the fifth embodiment of the present invention.
Figure 11B:
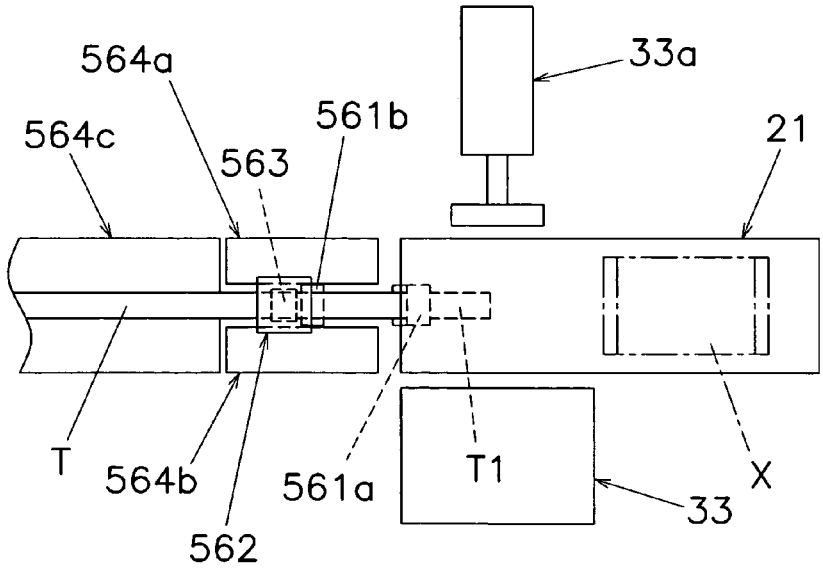
FIG. 11(B) is a plan view of the product inspection system according to the fifth embodiment of the present invention.

As shown in FIG. 11(A) and FIG. 11(B), herein, first and second carry-out conveyors 564*a*, 564*b*, 564*c*, which are arranged in a linearly extended manner from the transport conveyor 21, are used in place of the carry-out conveyor 64, which is spaced apart from the transport conveyor 21 in the width direction. In other words, the transport conveyor 21 and the first and second carry-out conveyors 564*a*, 564*b*, 564*c* are arrayed in a row in a plan view, as shown in FIG. 11 (B). In addition, the first and second carry-out conveyors 564*a*, 564*b*, 564*c* are arranged at the same height as the transport conveyor 21, as shown in FIG. 11 (A). The carry-out conveyor 564*c* has the same width as the transport conveyor 21, but the first carry-out conveyors 564*a*, 564*b* arranged therebetween have a width of less than half the width of the second carry-out conveyor 564*c* and the transport conveyor 21. Further, the strip tape T is paid out from below the transport conveyor 21 to above the carry-out conveyor 564*c* through the space widthwise between the first carry-out conveyor 564*a*, and the first carry-out conveyor 564*b*.

Along with the carry-out conveyor 564*c*, a feed roller 561*b*, which holds the strip tape T substantially horizontally below the pressing mechanism 562 (discussed later), is arranged in the space between the first carry-out conveyor 564*a*, and the first carry-out conveyor 564*b* in the width direction. A vertical pair of payout rollers 561*a* and the tape roll T1 are arranged in the space below the transport conveyor 21.

The pressing mechanism 562 and a heater block 563, which sandwich the strip tape T and the product X and weld them together by heat and pressure, are arranged above and below the strip tape T. The strip tape T is paid out widthwise (left-right direction) between the first carry-out conveyor 564*a*, and the first carry-out conveyor 564*b*. The heater block 563 is arranged adjacent to the front side of the feed roller 561*b*. The upper surface of the heater block 563 is positioned slightly below the lower surface of the strip tape T. The pressing mechanism 562 is a mechanism that presses the transverse seal part of the product X and the strip tape T to the heater block 563 by a pressing member 562*a* that performs vertically reciprocating motion. The pressing mechanism 562 is arranged directly above the heater block 563. When the pressing member 562*a* moves downwards, as shown in the chain double-dashed line in FIG. 11(A), the product X and the strip tape T are sandwiched between the pressing member 562*a* and the heater block 563, and both the product X and the strip tape T are thermally welded by heat and pressure.

Furthermore, herein, the defective product collection box 33 is disposed on the left side of a part close to the tip of the transport conveyor 21. Also, a pusher 33*a* for dropping products X determined to be defective products into the defective product collection box 33, is arranged at a position opposite the defective product collection box 33, with the pusher 33*a* and the defective product collection box 33 interposing the transport conveyor 21.

The following explains the operation of the strip tape mounting system of the present embodiment.

The product X is transported by the transport conveyor 21 and first the carry-out conveyors 564*a*, 564*b*. When the transverse seal part of the rear end of the product X arrives above the heater block 563, the pressing member 562*a* of the pressing mechanism 562 moves downward, and the product X and the strip tape T are sandwiched between the pressing member 562*a* and the heater block 563. Thereby, the transverse seal part of the product X and the strip tape T are welded. Subsequently, the first and second carry-out conveyors 564*a*, 564*b*, 564*c* move by at least the prescribed distance, and then stand by to allow the next product X to be welded to the strip tape T.

In the strip tape mounting system of the present embodiment as well, the second carry-out conveyor 564*c* and the feed roller 561*b* hold the strip tape T in a horizontal state, and the products X are mounted to the strip tape T such that the transverse seal parts of the products X vertically overlap with the strip tape T. Consequently, this reduces the risk that the relative positions of the products X and the strip tape T undesirably deviate from the stipulated positions during the mounting. In addition, practically none of the weight of the product X itself is borne by the part of the product X being welded and the strip tape T. Therefore, the products X are not likely to fall off the strip tape T after the welding.

Sixth Embodiment

The strip tape mounting system according to the sixth embodiment of the present invention will now be explained. Furthermore, the same symbols will be used for constituent elements that are similar to those the abovementioned first embodiment, to the extent that it does not invite confusion.

Figure 12:
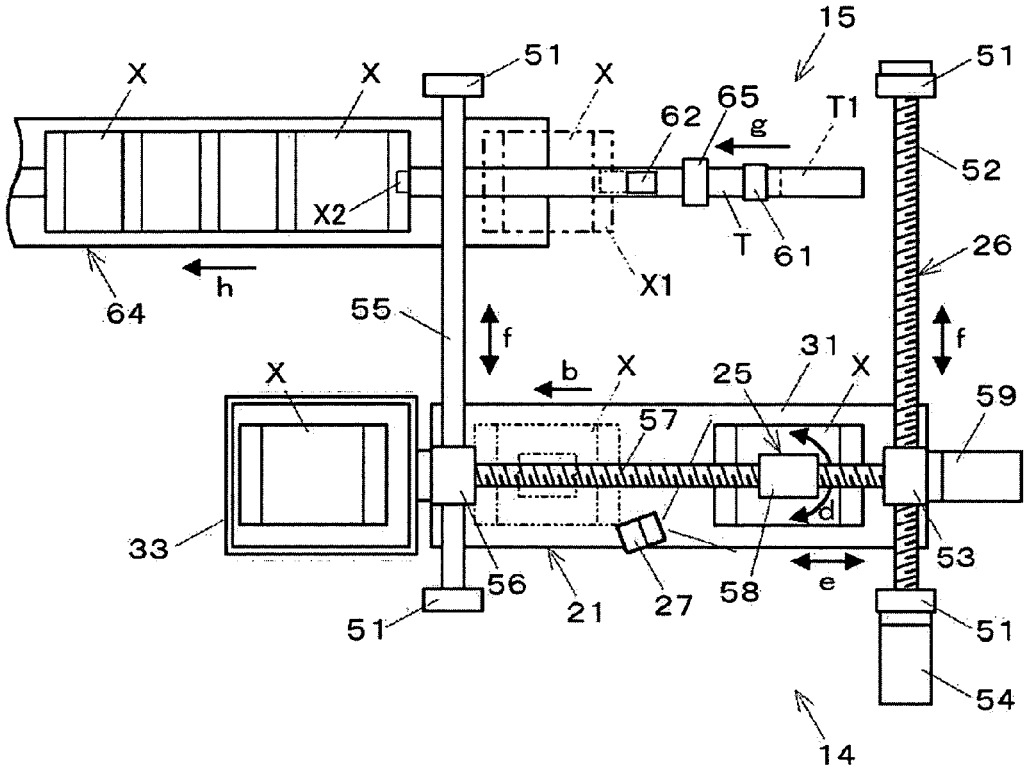
FIG. 12 is a plan view of the strip tape mounting system according to the sixth embodiment of the present invention.

In the abovementioned first embodiment, the strip tape mounting apparatus 15 was provided with a clamp 62 and a heater block 63, and the clamp 62 and the heater block 63 sandwiched and welded the transverse seal part X1 of the product X and the strip tape T. Here, in place of a structure that thermally welds the product X to the strip tape T by the addition of heat and pressure, it is also acceptable to adopt a structure wherein the strip tape mounting apparatus 14 further includes an adhesive application device 65 for applying adhesive to the strip tape T as shown in FIG. 12. In that case, the product X is bonded to the strip tape T by rendering the strip tape T partially adhesive, or by adding an adhesive substance to the strip tape T, and the like.

For example, the part on the strip tape T where the product X is mounted is notched, and an adhesive tape is applied to the portion surrounding that notch so that the adhesive tape covers the notch. When such a strip tape is used, then the part of the strip tape T where the product X is mounted becomes adhesive, and the product X can be mounted to the strip tape T just by pressing the product X to that adhesive part.

In addition, it is also acceptable to attach a two-sided adhesive tape to the part of the strip tape T where the product X is mounted. If such two-sided adhesive tape is used, the strip tape T will have adhesiveness in the part where the product X is mounted, and the product X can consequently be mounted to the strip tape T just by pressing the product to that part where the adhesive tape is attached.

In addition, as disclosed in U.S. Pat. No. 3,864,895, it is also possible to use a strip tape mounting apparatus wherein a substance having adhesiveness, such as a hot melt, is sprayed on the strip tape T at a pitch at which the product X is mounted, and the product X is pressed against that sprayed part.

Furthermore, it is also acceptable to use a strip tape T that renders adhesiveness by heating, to heat the part of the strip tape where the product X is to be mounted immediately before mounting the product X, and to bond the product X to the strip tape T by pressing the product X against the part that became adhesive.

Furthermore, where a product X is bonded to the strip tape T using adhesive power, it is preferable to control the pitch of the intermittently driven carry-out conveyor 64 and payout rollers 61 based on a signal from the detection apparatus (not shown) that detects the registration mark of the strip tape T.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least±5% of the modified term if this deviation would not negate the meaning of the word it modifies.

This application claims priority to Japanese Patent Applications Nos. 2003-052727 and 2004-006619. The entire disclosure of Japanese Patent Applications Nos. 2003-052727 and 2004-006619 are hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A tape mounting system for mounting a bag containing a product to a tape, comprising:

a packaging apparatus that is configured to produce and discharge the bag by packaging a product therein;

a tape holding mechanism that is configured to hold the tape substantially horizontally and conveys the tape in a substantially horizontal direction;

a mounting mechanism that is configured to mount the bag to the tape by attaching a portion of the bag to the tape;

a bag transport mechanism that is configured to transport the bag discharged from said packaging apparatus toward said mounting mechanism, said bag transport mechanism configured to grasp the bag and maintain the bag in the horizontal orientation while the bag is being transported toward said mounting mechanism; and a control unit operatively coupled to said tape holding mechanism, said mounting mechanism, and said bag transport mechanism, and configured to control said tape holding mechanism, said mounting mechanism, and said bag transport mechanism such that the portion of the bag vertically overlaps the tape while the portion of the bag is attached to the tape, and that the tape holding mechanism conveys the bag attached to the tape in the substantially horizontal direction.

2. The tape mounting system as recited in claim 1, wherein the tape is made of a material that is more flexible than a material of which the bag is made.

3. The tape mounting system as recited in claim 1, wherein said mounting mechanism has a heater, and said mounting mechanism is configured to attach the portion of the bag to the tape by heating said heater.

4. The tape mounting system as recited in claim 1, wherein said mounting mechanism has a pressing member, and said control unit is configured to control said pressing member to press the portion of the bag toward said tape holding mechanism, such that the portion of the bag and the tape vertically overlap while the portion of the bag is attached to the tape.

5. The tape mounting system as recited in claim 1, wherein the tape is rendered adhesive at least at a part to which the portion of the bag is attached, and said mounting mechanism is configured to attach the portion of the bag to the tape by pressing the portion against the tape.

6. The tape mounting system as recited in claim 1, wherein said mounting mechanism further includes an adhesive application device that applies an adhesive substance to the tape, and said mounting mechanism is configured to attach the portion of the bag to the tape via the adhesive substance.

7. The tape mounting system as recited in claim 1, further comprising:

a product placing mechanism that is configured to place the bag onto said mounting mechanism, said control unit being configured to control said product placing mechanism such that the portion of the bag vertically overlaps the tape while the portion of the bag is attached to the tape.

8. The tape mounting system as recited in claim 1, wherein said product transport mechanism and said tape holding mechanism are spaced apart in a width direction.

9. The tape mounting system as recited in claim 1, wherein said product transport mechanism and said tape holding mechanism are spaced apart in the vertical direction.

10. The tape mounting system as recited in claim 7, wherein said product placing mechanism has a grasping member that is configured to grasp the bag, or a suction member that is configured to hold the bag by suction.

11. The tape mounting system as recited in claim 7, further comprising:

a product transfer mechanism that is configured to transfer said product placing mechanism toward said mounting mechanism.

12. The tape mounting system as recited in claim 11, wherein said product transfer mechanism has a product orientation change mechanism that is configured to change an orientation of the bag.

13. The tape mounting system as recited in claim 7, wherein said product placing mechanism is configured to apply pressure to the bag, such that said control unit performs a seal check of the bag.

14. The tape mounting system as recited in claim 11, further comprising:

an imaging unit that is configured to produce an image signal of the bag before the bag is mounted onto the tape; and said control unit is configured to control said product transfer mechanism based on the image signal from said imaging unit.

15. The tape mounting system as recited in claim 1, wherein said tape holding mechanism is disposed in a linearly extended manner from said product transport mechanism and is spaced apart from the product transport mechanism in the vertical direction.

16. The tape mounting system as recited in claim 4, wherein said mounting mechanism has a heater, and said control unit is configured to control said pressing member such that said pressing member and said heater sandwich the portion of the bag and the tape to attach them together.

17. The tape mounting system as recited in claim 7, wherein said product placing mechanism further includes a weight detection unit configured to detect a weight of the product.

18. The tape mounting system as recited in claim 13, wherein said control unit is configured to control said product placing mechanism to place the bag onto said mounting mechanism only if the bag is not a defective bag based on the seal check.

19. A tape mounting system for mounting a bag containing a product to a tape, comprising:

a packaging apparatus that is configured to produce and discharge the bag by packaging a product therein;

a tape holding mechanism that is configured to hold the tape substantially horizontally and conveys the tape in a substantially horizontal direction;

a mounting mechanism that is configured to mount the bag to the tape by attaching a portion of the bag to the tape;

a bag transport mechanism that is configured to transport the bag discharged from said packaging apparatus toward said mounting mechanism, said bag transport mechanism configured to grasp the bag and maintain the inclination of the bag in the horizontal plane while the bag is being transported toward said mounting mechanism; and a control unit operatively coupled to said tape holding mechanism, said mounting mechanism, and said bag transport mechanism, and configured to control said tape holding mechanism, said mounting mechanism, and said bag transport mechanism such that the portion of the bag vertically overlaps the tape while the portion of the bag is attached to the tape, and that the tape holding mechanism conveys the bag attached to the tape in the substantially horizontal direction.

20. The tape mounting system as recited in claim 1, wherein the bag transport mechanism configured to grasp a surface of the bag and maintain the inclination of the bag in the horizontal plane while the bag is being transported toward said mounting mechanism.

21. The tape mounting system as recited in claim 1, wherein the bag transport mechanism comprises a chuck configured to grasp the bag.

22. The tape mounting system as recited in claim 1, wherein the bag transport mechanism comprises a plurality of grasping members configured to grasp corners of the bag.

23. The tape mounting system as recited in claim 19, wherein the bag transport mechanism is configured to grasp a surface of the bag and maintain the inclination of the bag in the horizontal plane while the bag is being transported toward said mounting mechanism.

24. The tape mounting system as recited in claim 19, wherein the bag transport mechanism comprises a chuck configured to grasp the bag.

25. The tape mounting system as recited in claim 19, wherein the bag transport mechanism comprises a plurality of grasping members configured to grasp corners of the bag.

* * * * *